US011273362B2

(12) United States Patent
Petutschnig

(10) Patent No.: US 11,273,362 B2
(45) Date of Patent: Mar. 15, 2022

(54) STEERING AXLE UNIT FOR SKATEBOARDS OR CHASSIS

(71) Applicant: Hubert Petutschnig, Brunn Am Gebirge (AT)

(72) Inventor: Hubert Petutschnig, Brunn Am Gebirge (AT)

( * ) Notice: Subject to any disclaimer, the term of this patent is extended or adjusted under 35 U.S.C. 154(b) by 0 days.

(21) Appl. No.: 16/498,963

(22) PCT Filed: Mar. 2, 2018

(86) PCT No.: PCT/AT2018/000011

§ 371 (c)(1),
(2) Date: Sep. 27, 2019

(87) PCT Pub. No.: WO2018/176070

PCT Pub. Date: Oct. 4, 2018

(65) Prior Publication Data

US 2020/0376361 A1 Dec. 3, 2020

(30) Foreign Application Priority Data

Mar. 30, 2017 (WO) ..... PCT/EP2017/000529
May 5, 2017 (AT) ..... A 184/2017
Jun. 12, 2017 (AT) ..... A 252/2017

(51) Int. Cl.
*A63C 17/01* (2006.01)
*A63C 17/26* (2006.01)

(52) U.S. Cl.
CPC ..... *A63C 17/012* (2013.01); *A63C 17/015* (2013.01); *A63C 17/265* (2013.01); *A63C 2203/42* (2013.01)

(58) Field of Classification Search
CPC .. A63C 17/012; A63C 17/015; A63C 2203/42
See application file for complete search history.

(56) References Cited

U.S. PATENT DOCUMENTS 7,104,558 B1 * 9/2006 Saldana ..... A63C 17/0093 280/11.27
8,888,108 B1 * 11/2014 Beaty ..... A63C 17/0093 280/11.27

(Continued)

FOREIGN PATENT DOCUMENTS

FR 2 431 309 A1 2/1980
FR 2 810 895 A1 1/2002

OTHER PUBLICATIONS

English Translation of the International Search Report (ISR) for PCT/AT2018/000011 dated Jul. 2, 2018, pp. 1-2.

*Primary Examiner* — Brian L Swenson
(74) *Attorney, Agent, or Firm* — McDonnell Boehnen Hulbert & Berghoff LLP

(57) ABSTRACT

A steering axle unit (24) for chassis or skateboards, comprising a bearing block (1) and a steering axle body (98), wherein the bearing block (1) has a fastening plane (11) for fastening to a chassis or skateboard, particularly skateboard deck (52), wherein, in the assembled state, the fastening plane (11) is arranged on the chassis or skateboard particularly so as to be parallel to the designated direction of travel (25) of the chassis or skateboard, and wherein the bearing block (1) comprises a vertical axis CD (22) about which the steering axle unit (98) is arranged so as to rotate relative to the bearing block (1), an axle (8) that projects normally from the vertical median longitudinal plane of the bearing block (1) in the straight-ahead position being arranged on the steering axle body (98), wherein the vertical axis CD (22) is arranged on the median longitudinal plane of the bearing block (1) at an angle W1 (19) of less than 90° relative to the fastening plane (11) in the direction of the steering axle body (98), wherein the axle (8) is arranged at a normal distance (20) to the vertical axis CD (22), and wherein the axle (8) is (Continued)

Figure 1:
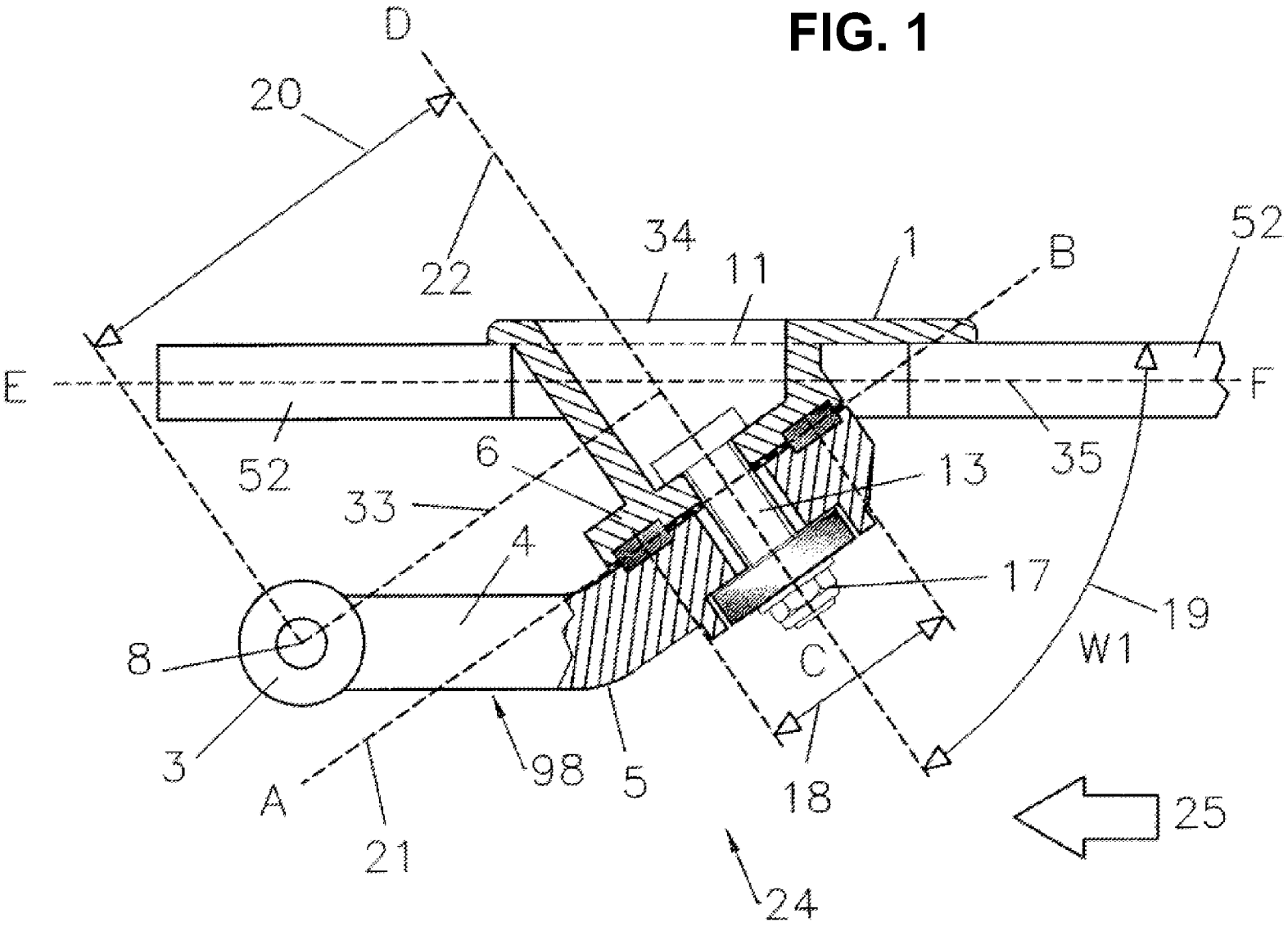

arranged in front of the vertical axis CD (22) in the designated direction of travel (25) of the chassis or skateboard.

17 Claims, 18 Drawing Sheets

(56) References Cited

U.S. PATENT DOCUMENTS

| | | | | |
|---|---|---|---|---|
| 10,384,116 | B1 * | 8/2019 | Yeh | A63C 17/0093 |
| 2002/0125670 | A1 * | 9/2002 | Stratton | A63C 17/01 280/87.041 |
| 2002/0135147 | A1 * | 9/2002 | Lee | A63C 17/26 280/87.041 |
| 2005/0051983 | A1 * | 3/2005 | Williams | A63C 17/012 280/87.042 |
| 2005/0051984 | A1 * | 3/2005 | Williams | A63C 17/012 280/87.042 |
| 2005/0093262 | A1 * | 5/2005 | Chang | A63C 17/0093 280/87.042 |
| 2013/0113170 | A1 | 5/2013 | Braden et al. | |
| 2013/0175777 | A1 * | 7/2013 | Bermal | A63C 17/0093 280/87.042 |
| 2013/0270781 | A1 * | 10/2013 | Kuyt | A63C 17/012 280/11.28 |
| 2014/0251072 | A1 | 9/2014 | LaBrie et al. | |
| 2020/0282294 | A1 * | 9/2020 | Anderson | A63C 17/02 |
| 2021/0008437 | A1 * | 1/2021 | Slagter | A63C 17/012 |

* cited by examiner $$S2 = \frac{S1}{\cos W3} \qquad W3 = \frac{H}{S1} \ (\tan^{-1})$$

$$H1(H2) = \tan W3 \times S1$$

STEERING AXLE UNIT FOR SKATEBOARDS OR CHASSIS

The invention relates to an axle arrangement or wheel suspension according to the preamble of claim 1. The invention further relates to a chassis, particularly a skateboard, having at least one axle arrangement or wheel suspension according to the invention.

Prior Art: Skateboards have always been designed in such a way that four screw bolts (so-called "kingpins") that project downward at an angle are provided on their underside in the front and back on the vertical longitudinal center plane. In a mirror-symmetrical arrangement, each of these two screw bolts carries a wheel axle body having an opening on its front side for the kingpin screws with recessed clearances for receiving and positioning the steering rubbers, and a pivot at its other end that is supported against the frame and also carries rollers or wheels on its outer ends, which project transverse to the direction of travel. In all conventional skateboard constructions, it is essential that the transverse central axis of the wheel axle body be in the immediate vicinity of the vertical kingpin axle. When the kingpin screws are tightened, the two wheel axle bodies of a skateboard move only slightly in mirror symmetry during operation under the influence of the force acting on the skateboard deck, which is generated on the one hand by the feet and by the weight of the rider and on the other hand by arbitrary or involuntary shifts in weight and consequently by the support of the wheels against the ground being driven over.

Drawbacks of the Prior Art: Skateboards have no steering in the traditional sense, but only the two axle bodies that project obliquely downward in a mirror-inverted manner and carry out a forced steering movement about their steering axis under the influence of the deck movement against the resistance of the elastic steering rubbers seated on the aforementioned kingpins. It is only as a result of the angle between the board plane of a chassis parallel to the ground and the axle bodies projecting downward in this angled manner that a relative steering movement occurs in relation to the vertical median longitudinal plane of the wheel axles that project transversely to the side. The connection between fixed bearing block and movable wheel axle of the wheel axle units (so-called "trucks") that are arranged on the vertical median longitudinal plane for transmitting force for directional steering and for stabilizing the deck is achieved through their upper and lower steering rubbers, which must be screwed sufficiently tightly by means of the kingpin screws in order to impart sufficient stability to the deck. If these screws are screwed too loosely, the deck of a skateboard no longer remains in the horizontal position without inclination under the weight of the driver, but rather lays over to one side, thus rendering the skateboard unridable. On the other hand, axles with very tightly bolted kingpins become so rigid that deck and steering can no longer be moved. The maximum achievable steering effect always follows from the sum of the deflection of both axles; in the case of a skateboard, however, with its two counter-steering axles, it is not possible to ride in small radii or even in circles in a stable manner and substantially without steering force. The steering capabilities of a skateboard, which are only very marginal already, and the greater overall height of a skateboard resulting from the design must therefore necessarily be compensated for by a high level of skill and intense training on the part of skateboard riders in terms of balance and body control and have greatly limited the target group worldwide to this day.

It is the object of the invention to provide a wheel suspension for skateboards or chassis which, for the first time, makes it possible to travel in curves with small radii all the way up to circles in a safe, smooth, and direct manner, the deck of such a chassis or skateboard that is equipped with this axle having to remain in a stable, straight-ahead direction while riding straight ahead, very particularly while pushing off with a leg and providing a driving force that is oblique to the direction of travel. Another object is to reduce the height of the standing surface through the especially low design of the axles to the extent that the risk of an inexperienced rider falling is diminished substantially. The intention is to provide a means of transportation that can be used by a larger target group substantially without age restriction and does not require any special skill in order to ride, but rather only an average level of skill that is possessed by anyone, in principle, who is already able to ice skate or rollerblade.

This object is achieved by the features in the characterizing part of claim 1. In order to perform directional steering, a front movable wheel axle body swivels about an oblique vertical axis with a transverse axle that is spaced apart therefrom in the direction of travel and carries rollers or wheels. During swiveling of such an axle construction mounted on a chassis, the farther in front of the oblique vertical axis the transverse axle is constructively located, the farther away the front wheel on the inside of the curve automatically moves away from the vertical median longitudinal plane. On the one hand, greater constructive spacing of the axes brings about an enlargement of the area between the vertical median longitudinal plane and the two support points of the inside wheels; on the other hand, this increases the directional stability while riding, making this suspension particularly well suited for skateboards, longboards, cruisers, or similar chassis.

Advantageous developments of the wheel suspension according to the invention and possible combinations with conventional or similar wheel suspensions for chassis or skateboards are defined in the subclaims.

The inventive design of the novel wheel axle allows for an especially low deck that is close to the ground, with a novel product with very special, new riding characteristics being provided by virtue of the steering angle than can be moved freely about its vertical axis and projecting horizontally forward and upward in conjunction with a flat, preferably non-steerable rear axle, which product distinguishes itself from the conventional skateboard by its low overall height and an easy-to-learn, especially simple handling with palpable new riding dynamics and offers a level of riding safety that was hitherto unknown for skateboards. Quite unlike a standard skateboard, a rider is able to move a board according to the invention relatively safely from the outset and without skateboarding knowledge, including getting on, starting off, and steering, and it is even possible to ride in circles. Surprisingly, it has been shown and also demonstrated in a large number of experiments that only a very specific cross-sectional shape and mounting position of the movable steering angle in a relatively limited range of dimensions and angles thereof enables these effects to be achieved, including the particularly good directional stability, which is as if guided on rails, when the driver stands with only one foot on the board while kicking off with the second foot against the ground continuously but obliquely to the direction of travel.

In an advantageous embodiment, the transverse axle 8 carrying the rollers or wheels must be located in a very specific, limited region in front of the vertical axis CD 22 as seen in the direction of travel 25 in order to achieve these especially advantageous steering characteristics. This distance is defined below by the length of the normal distance 20 from the forwardly inclined vertical axis CD 22 as well as by the angle W1 thereof. Many practical experiments have shown that a normal distance 20 of about 40 mm or less results in an extremely steering-sensitive, tilting riding behavior, and a steering angle with a normal distance 20 of 80 mm or greater becomes increasingly difficult to steer, and that a board with such a longer steering axis can no longer be steered at all if the rider does not weigh enough. Relative to the position of the transverse axle 8, the vertical axis CD 22 is an optimal angular range W1 when between 40° to 60°, and even more dynamic steering is possible only within an even narrower range of between 45° and 50°. When the angle W1 is constructively greater than 50°, then palpable oversteering occurs while riding; at an angle W1 of less than 40°, the dynamic, palpable feeling for curves while riding is lost. As a result, the rider does not travel along the expected nimbly felt curve, but rather only along a flatter arch. All parameters refer initially to common boards measuring between about 700 to 1000 mm in length with a wheelbase of from about 600 to 850 mm and a non-directional rear axle. In order to reduce or enlarge the riding radius or to adapt to larger or smaller boards or chassis, however, other embodiments make constructive provisions for the possibility of a rear axle that can steer or counter-steer in any desired ratio, which influences only the riding radius of a board but not the steering behavior of the front axle. According to these advantageous embodiments, a provision is made that the movable steering axle body 98 is angled upward in the region 5, so that the transverse axle 8 provided on the axle body 3 constructively achieves an especially short spacing from the deck surface, whereby the rollers or wheels that are seated on the axle 8 in the installed position are able to reach approximately to the deck, resulting in an especially low clearance height of the deck surface from the ground. In conjunction with the direct steering of the front axle, the low board height brings about a safe riding experience right from the first riding attempts that was hitherto unknown for skateboards.

With regard to its cross-sectional shape, the steering axle body 98 is designed in such a way that the normal S1, which substantially determines the steering kinematics, has the inventively optimized distance 20 downward toward the front starting from the vertical axis CD 22 and ending in the axle midpoint 8. The range within which an optimal dimensioning of the steering axle in terms of optimum riding characteristics can be achieved consists of the parameters W1, W3, S1, 82, S3, and H (FIGS. 16 and 17) and is shown as a diagram in FIG. 18.

Figure 3:
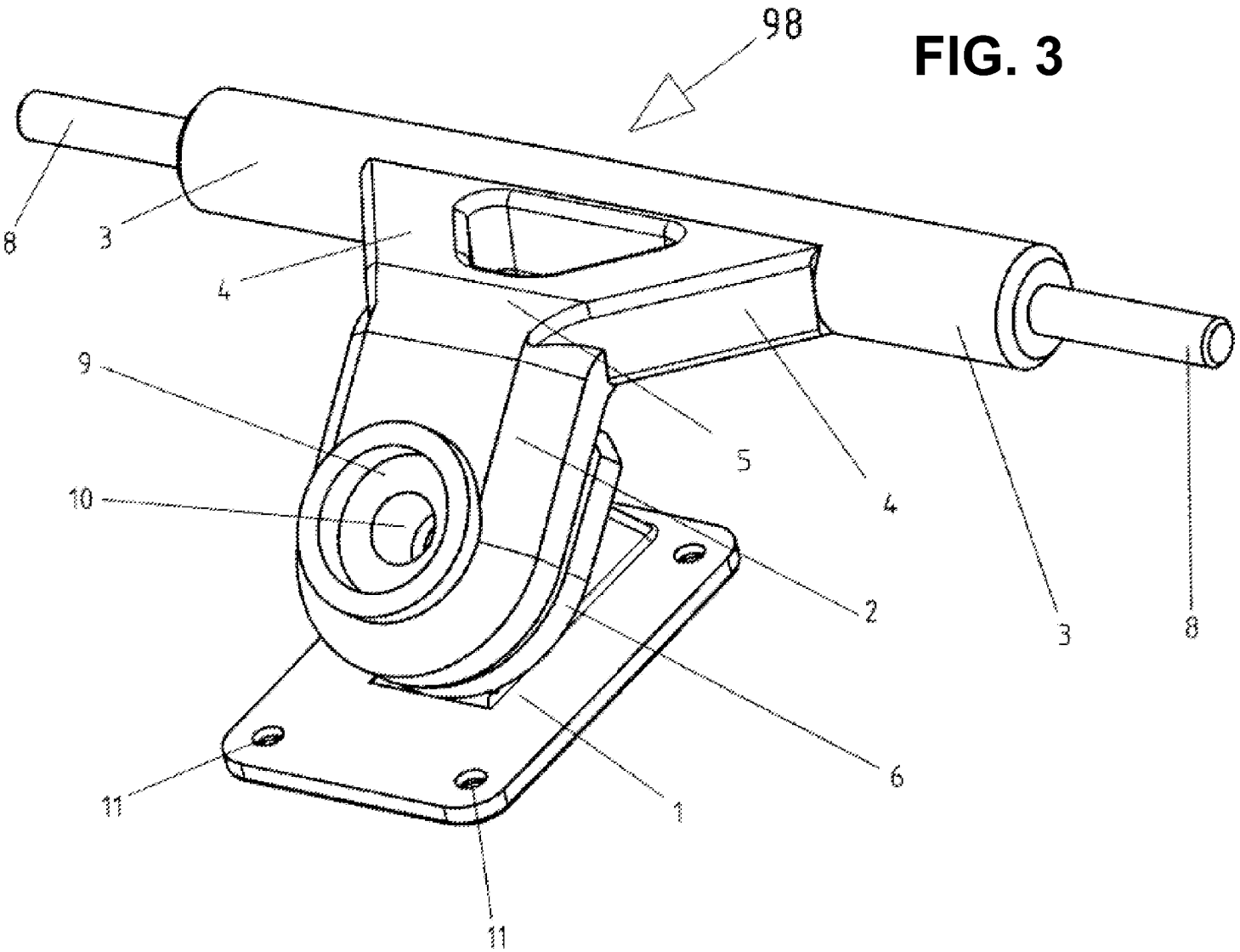
Figure 4:
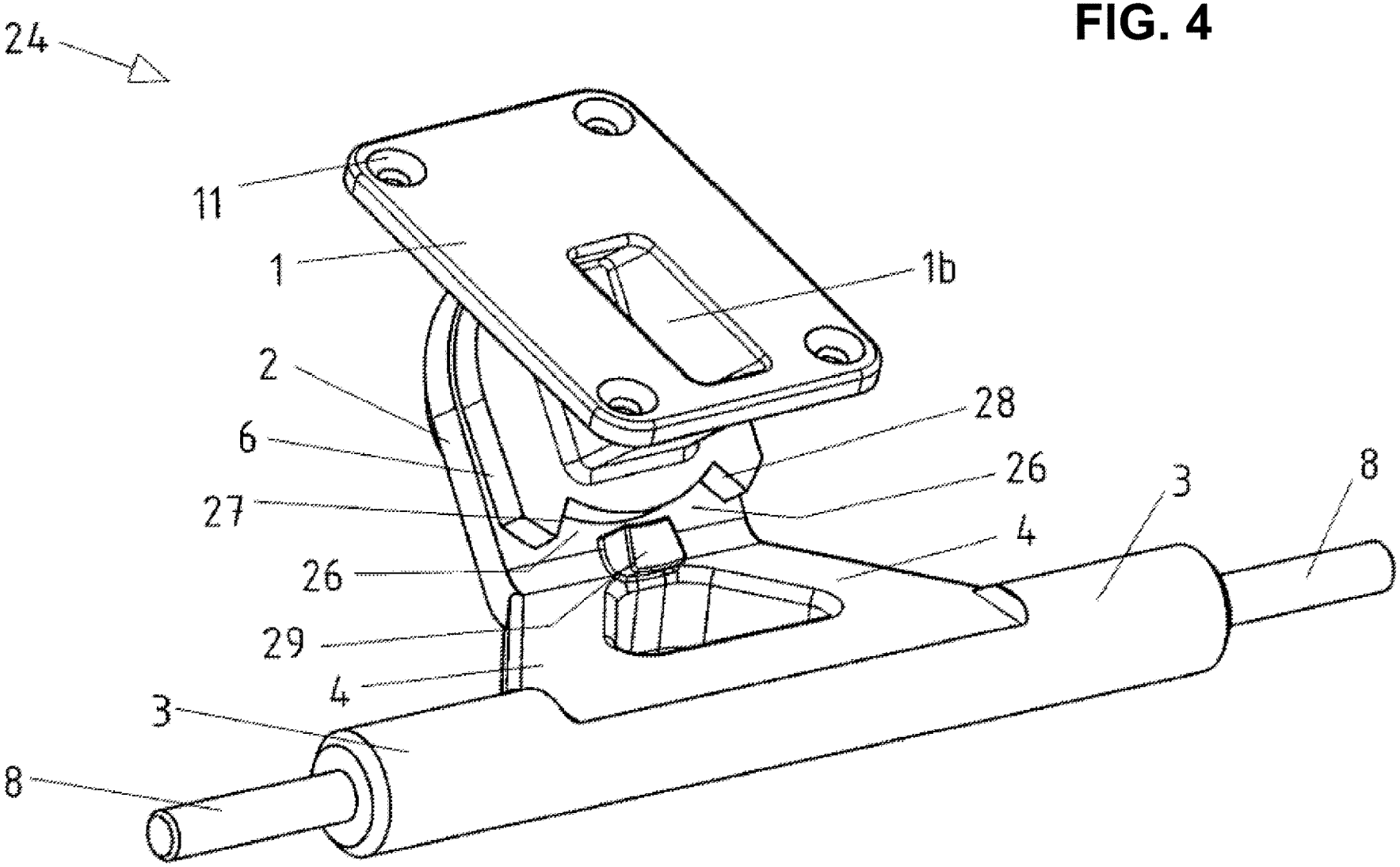
Figure 5A:
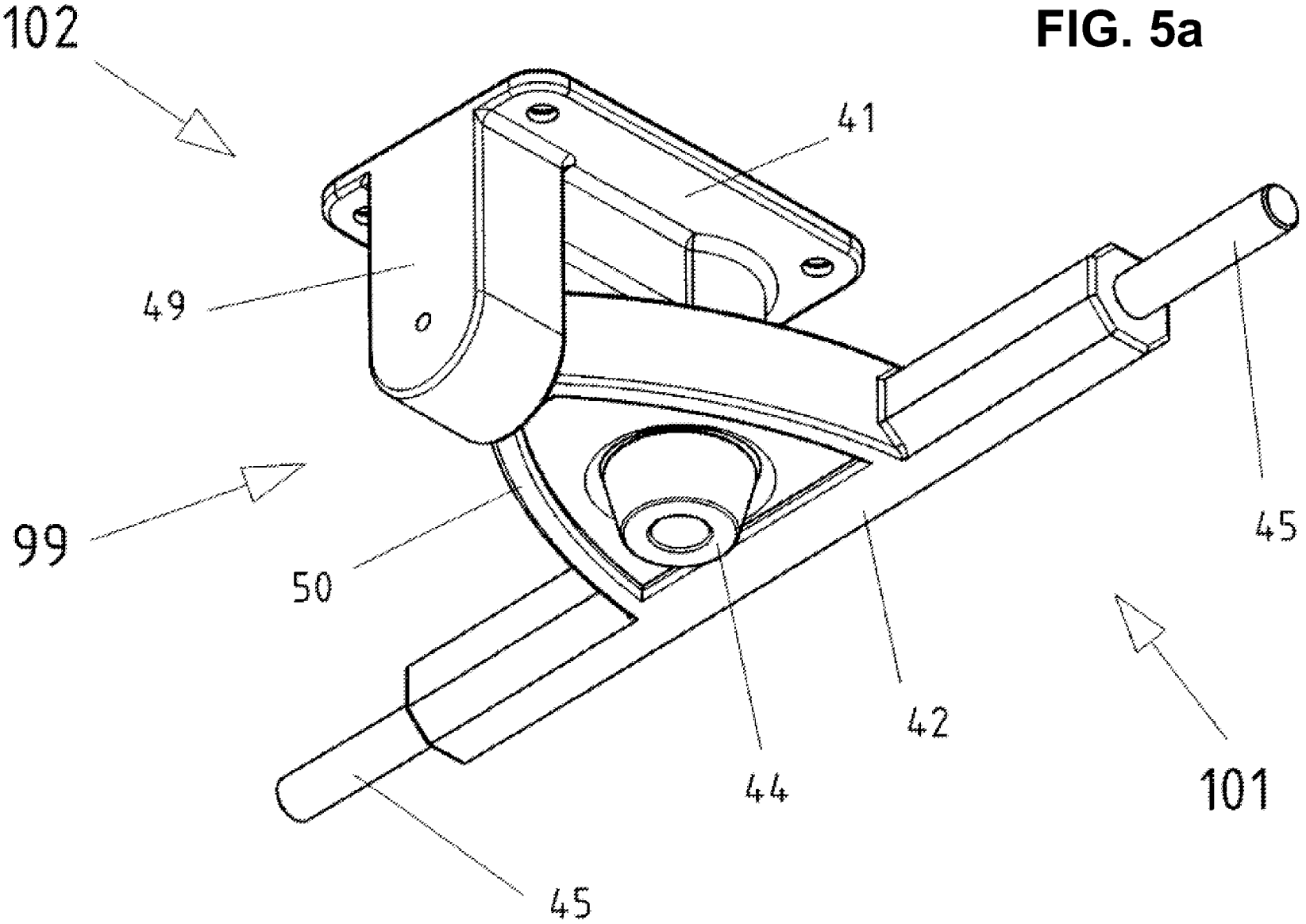
Figure 5B:
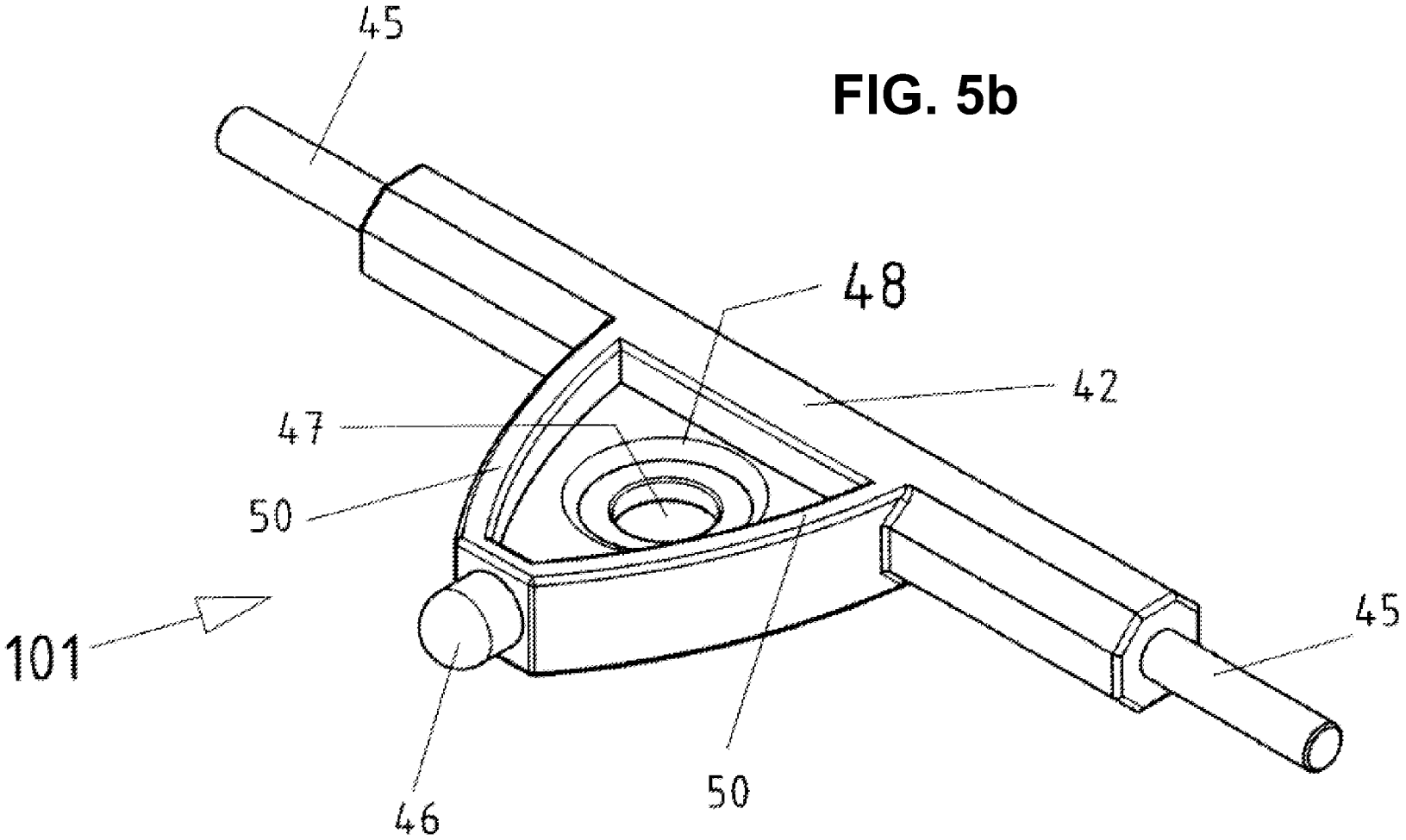
Figure 6A:
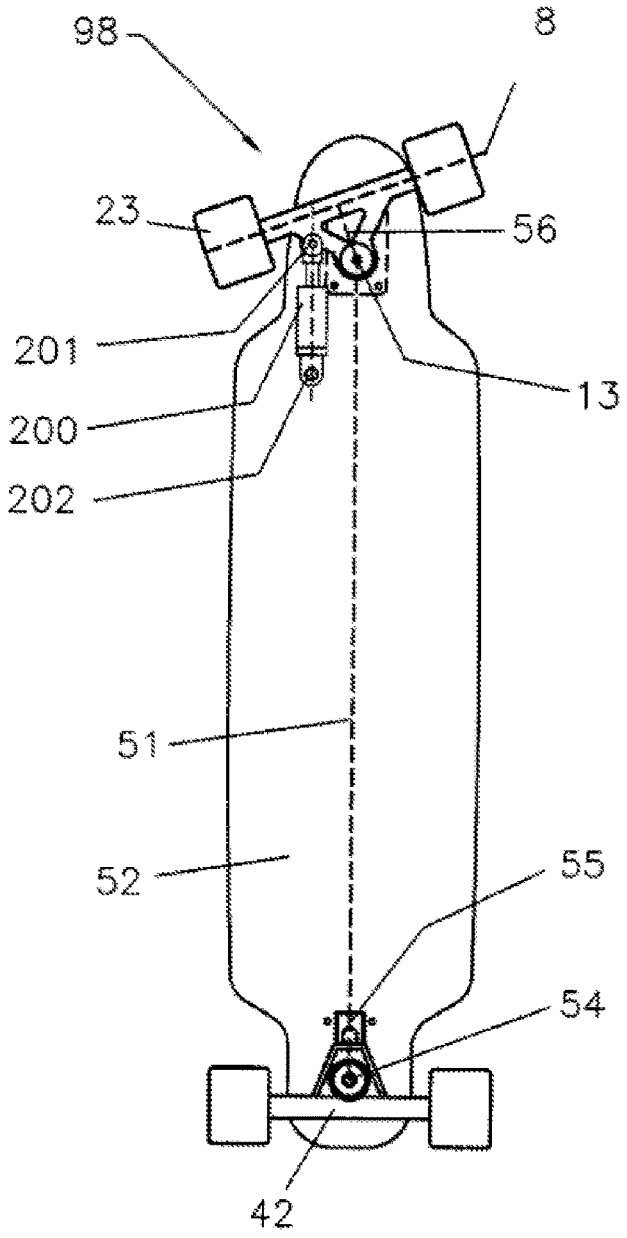
Figure 6B:
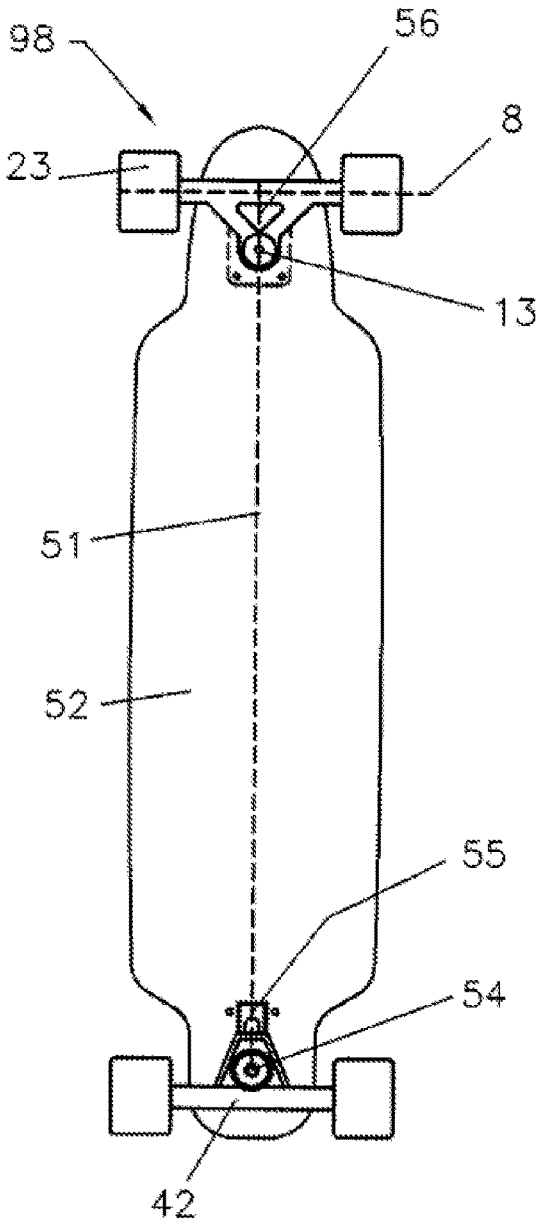
Figure 7:
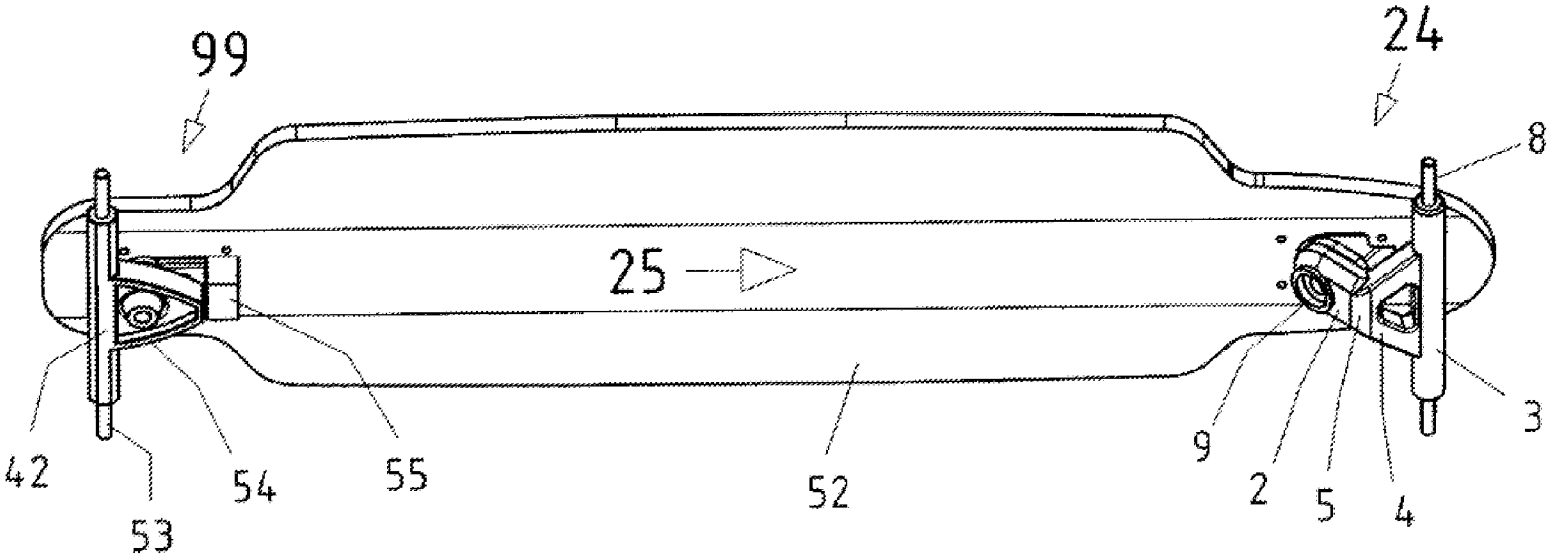
Figure 8A:
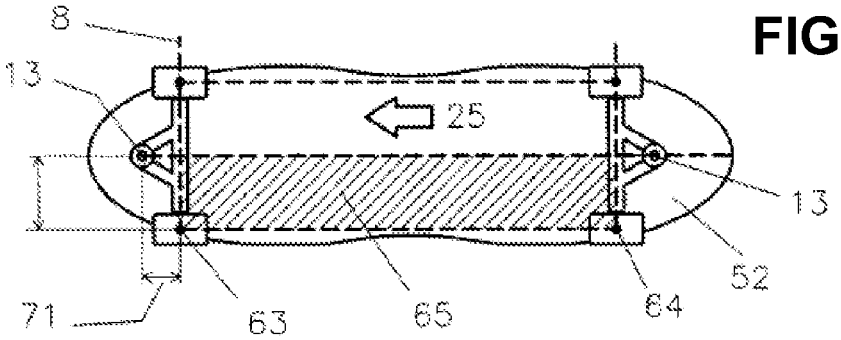
Figure 8B:
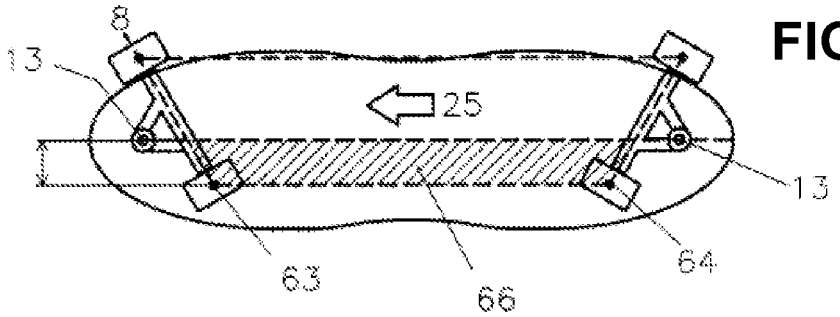
Figure 9A:
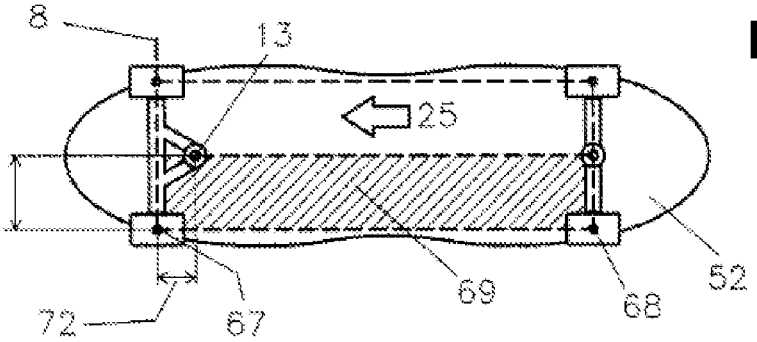
Figure 9B:
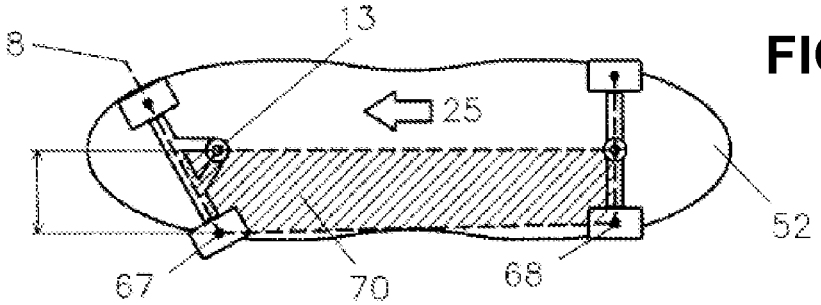
Figure 9C:
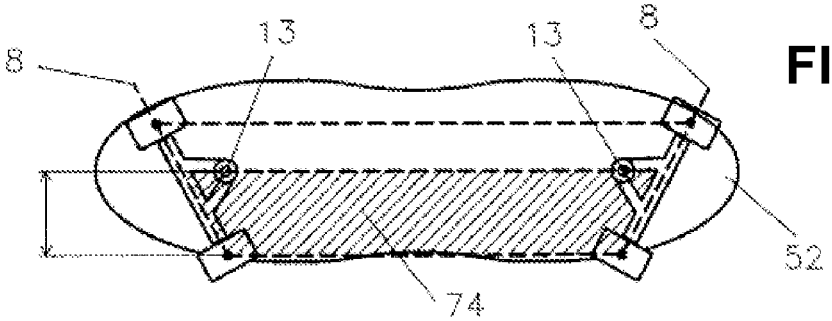
Figure 11:
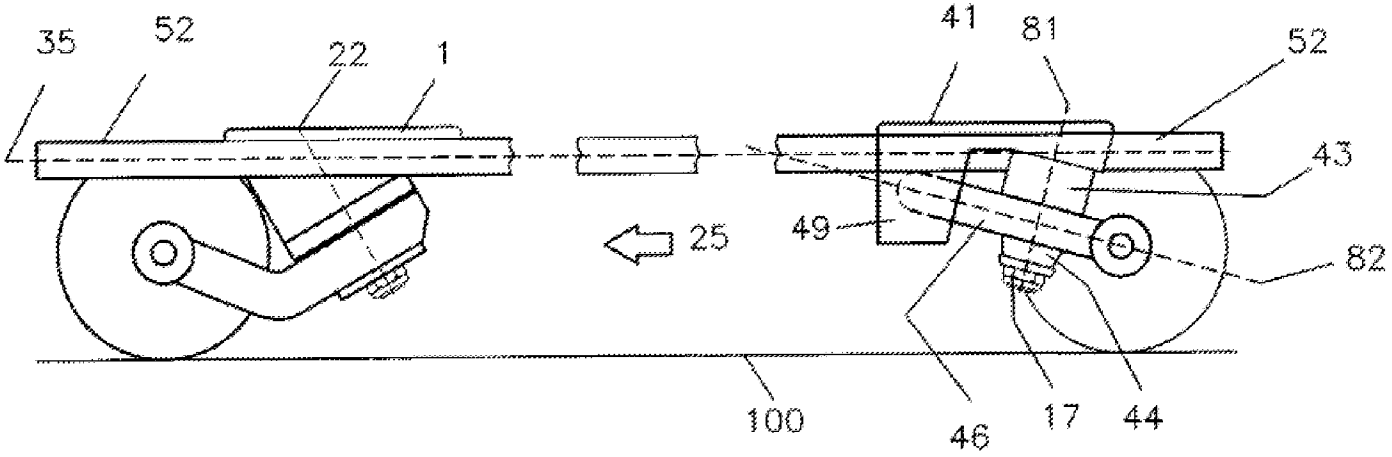
Figure 12:
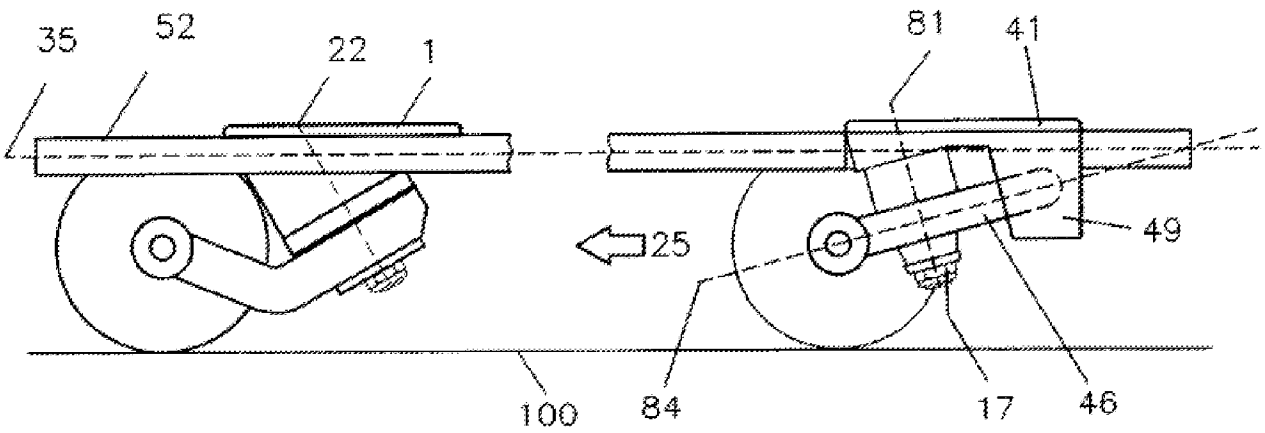
Figure 10:
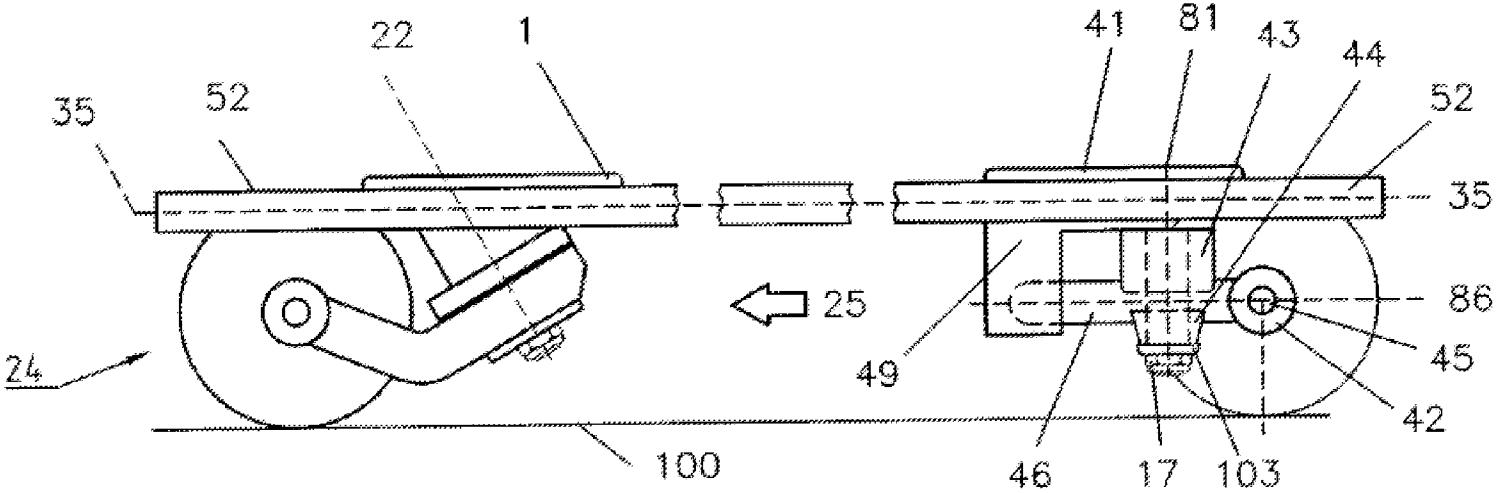
Figure 13:
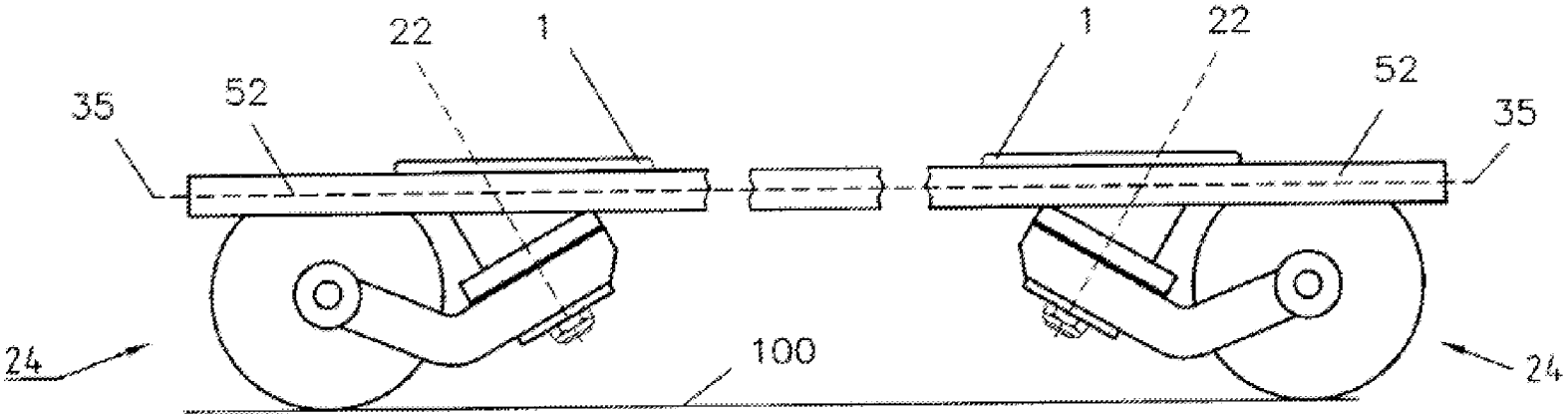
Figure 14C:
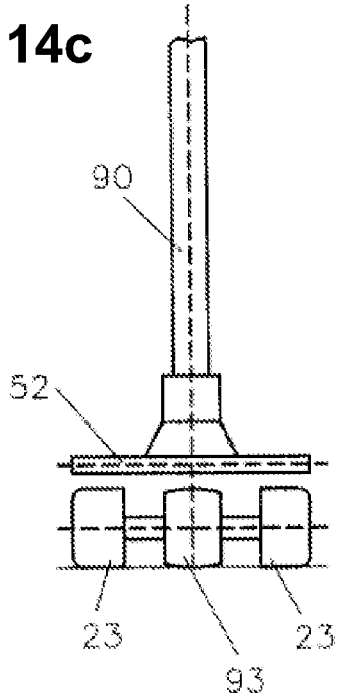
Figure 14B:
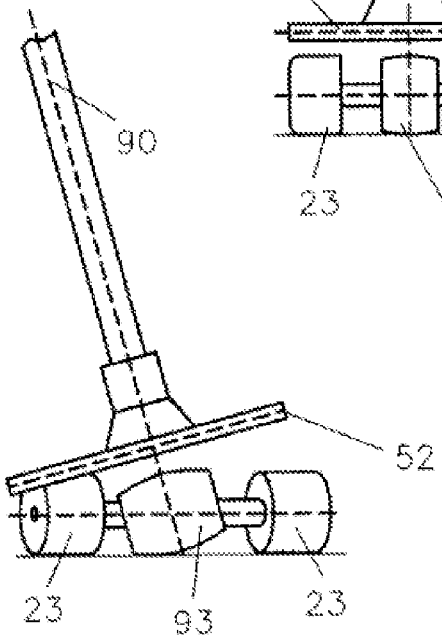
Figure 14A:
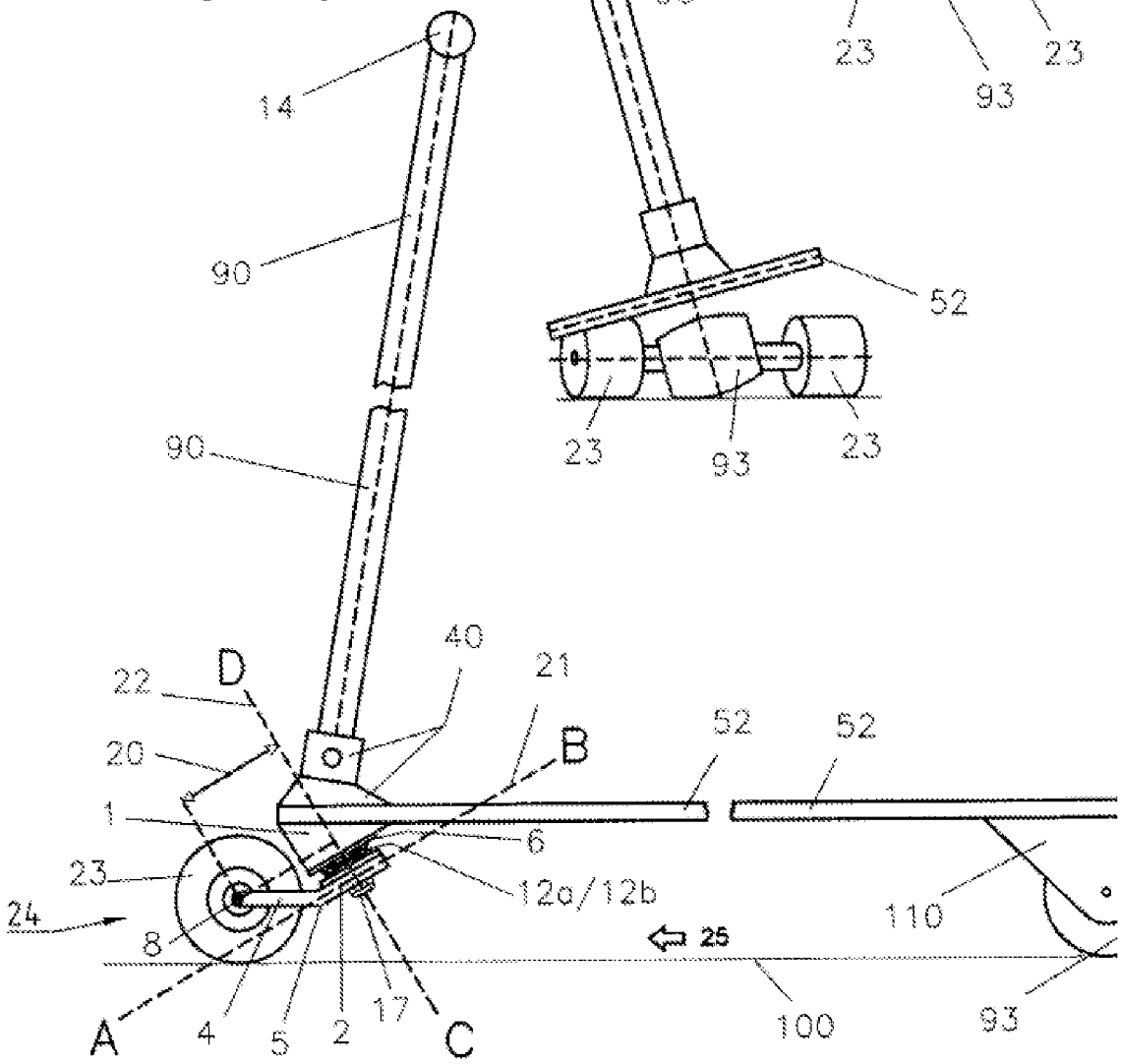
Figure 14D:
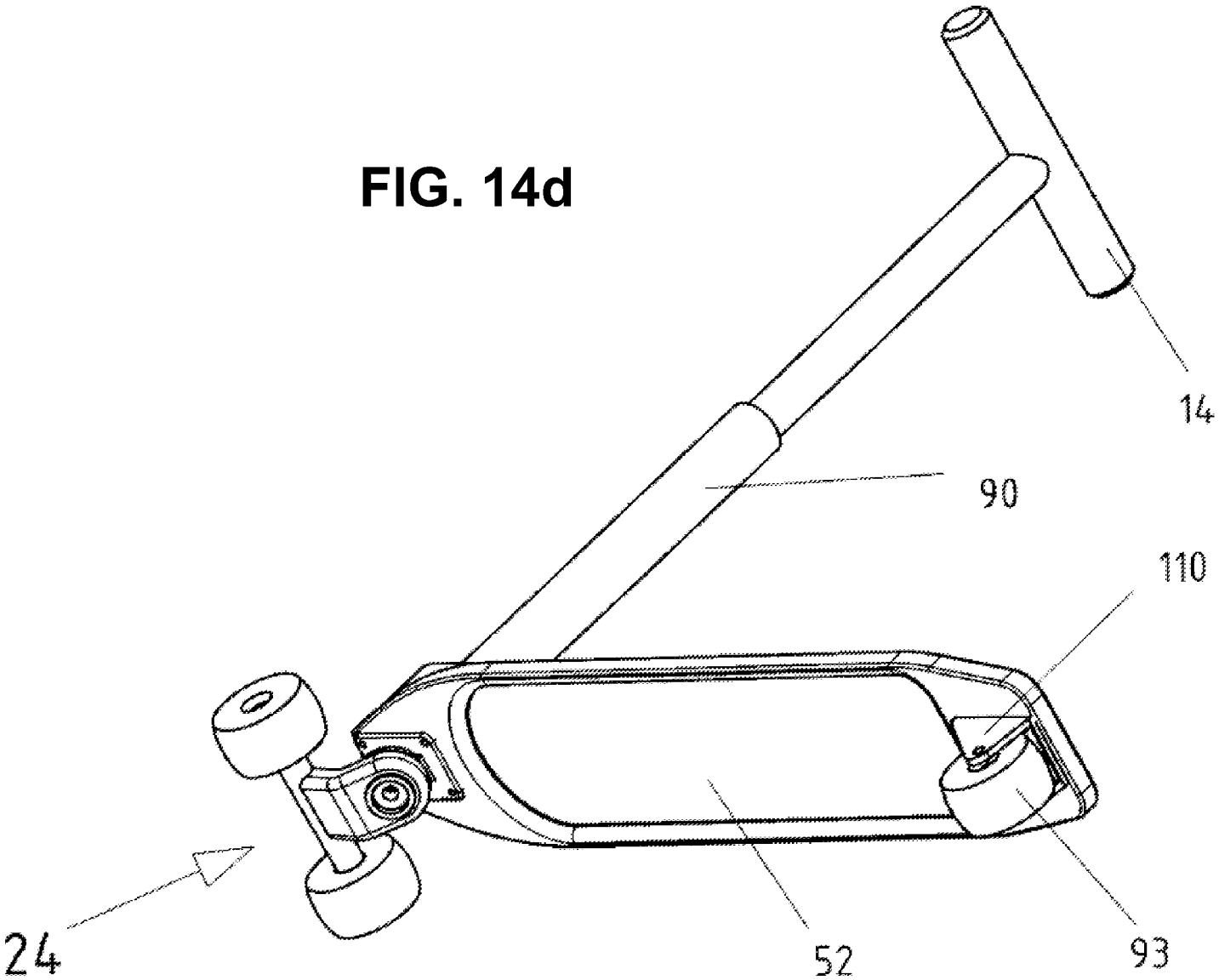
Figure 15:
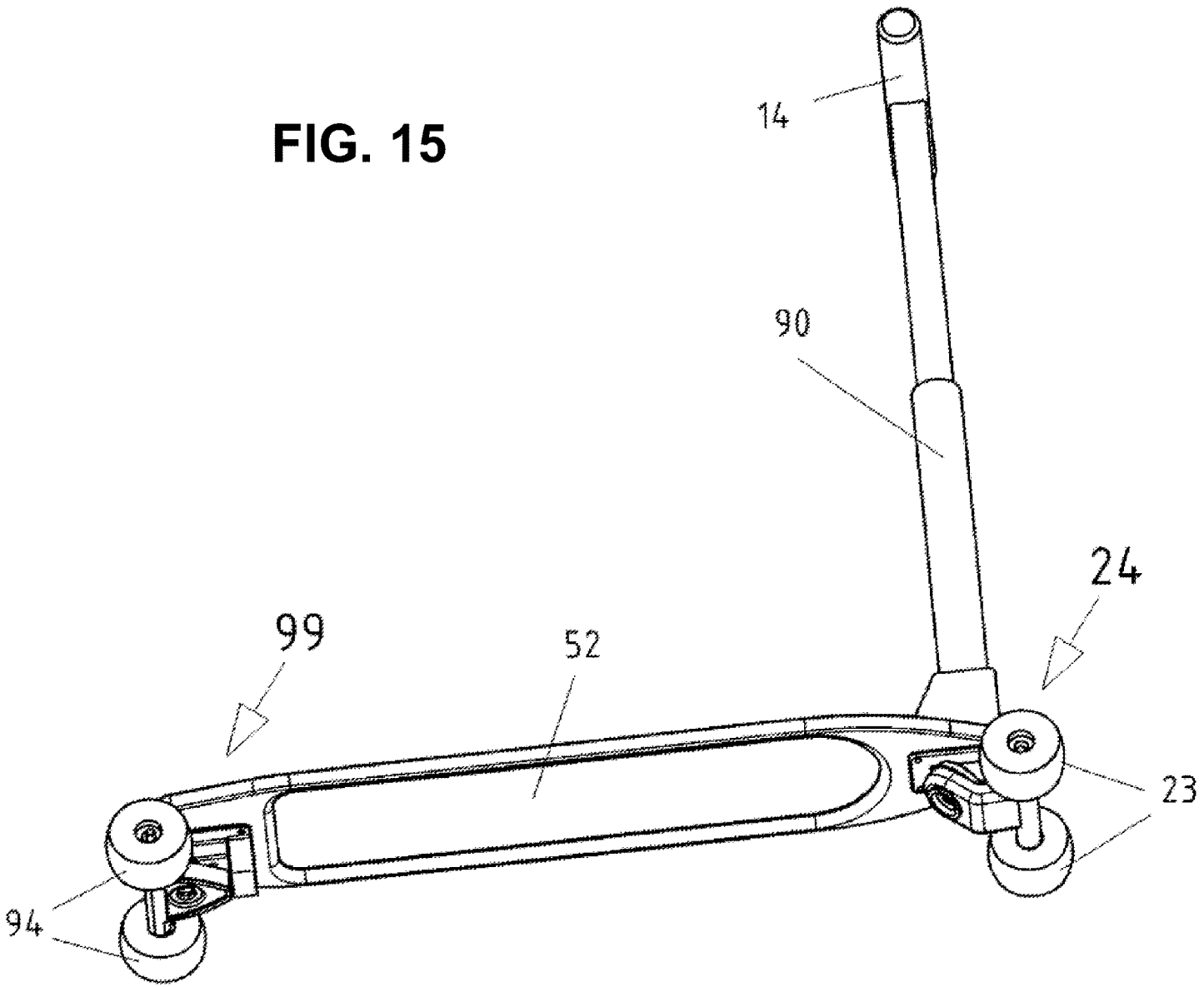

The invention is explained in greater detail below on the basis of exemplary embodiments of a skateboard or chassis. In the drawing, FIG. 1 shows a wheel suspension front axle, cross section FIGS. 2*a*, 2*b*, 2*c* and 2*d* shows a wheel suspension front axle, exploded views axial bearing FIG. 3 shows a wheel suspension front axle, oblique view from below FIG. 4 shows a wheel suspension front axle, view from above FIG. 5*a* shows a wheel suspension rear axle, oblique view from below FIG. 5*b* shows a rear axle, oblique view FIG. 6*a* shows a chassis or skateboard, front axle with steering shock absorber FIG. 6*b* shows a chassis or skateboard, front axle in neutral position for straight-ahead travel FIG. 7 shows a skateboard without mounted wheels, side view obliquely from below FIG. 8*a* shows a conventional wheel suspension, offset to the center of the skateboard, neutral position FIG. 8*b* shows a conventional wheel suspension, offset to the center of the skateboard, deflected FIG. 9*a* shows a front wheel suspension according to the invention, transverse axle in front of the vertical axis FIG. 9*b* shows a skateboard, front with a wheel suspension according to the invention, deflected FIG. 9*c* shows a skateboard with two wheel suspensions according to the invention, deflected FIG. 10 shows a skateboard with rear axle with a horizontal pivot FIG. 11 shows a skateboard with rear axle with a pivot that projects upward toward the front FIG. 12 shows a skateboard with rear axle with a pivot that projects upward toward the rear FIG. 13 shows a skateboard with two wheel suspensions according to the invention FIG. 14*a* shows a skateboard or chassis with a handlebar, side view FIG. 14*b* shows a skateboard or chassis with a handlebar, deflected FIG. 14*c* shows a skateboard or chassis with a handlebar, neutral position FIG. 14*d* shows a skateboard or chassis with 3 wheels and a handlebar FIG. 15 shows a skateboard or chassis and a handlebar with 4 wheels FIG. 16 geometric ratios with respect to the steering angle shape with the height H1

Figure 17:
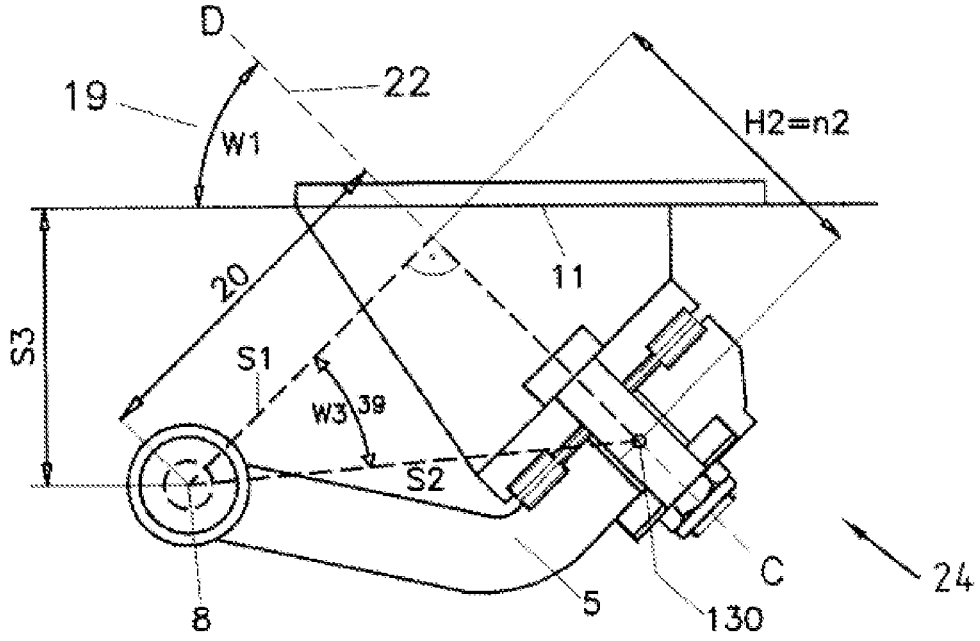

FIG. 17 geometric ratios with respect to the steering angle shape with the height H2

Figure 18:
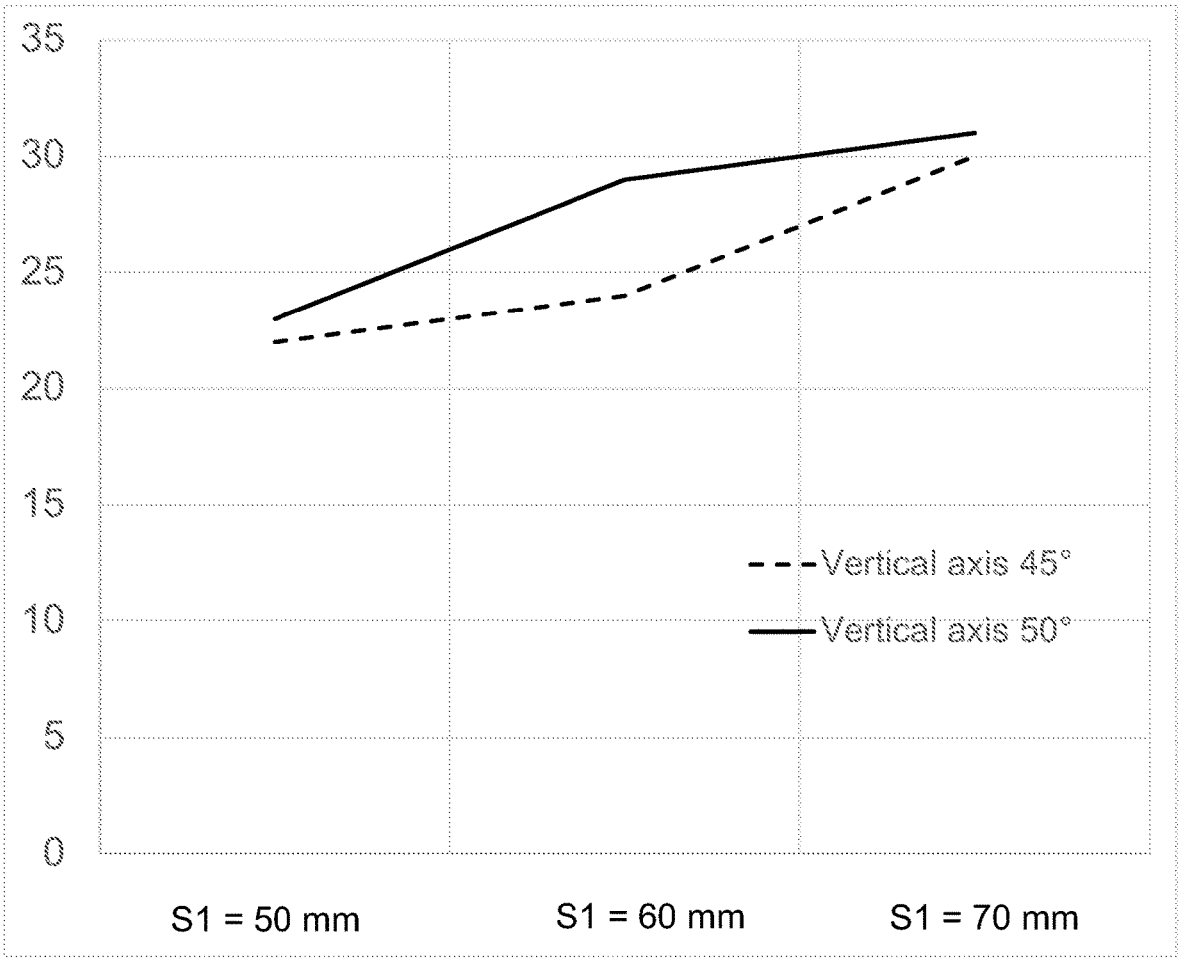
Figure 19:
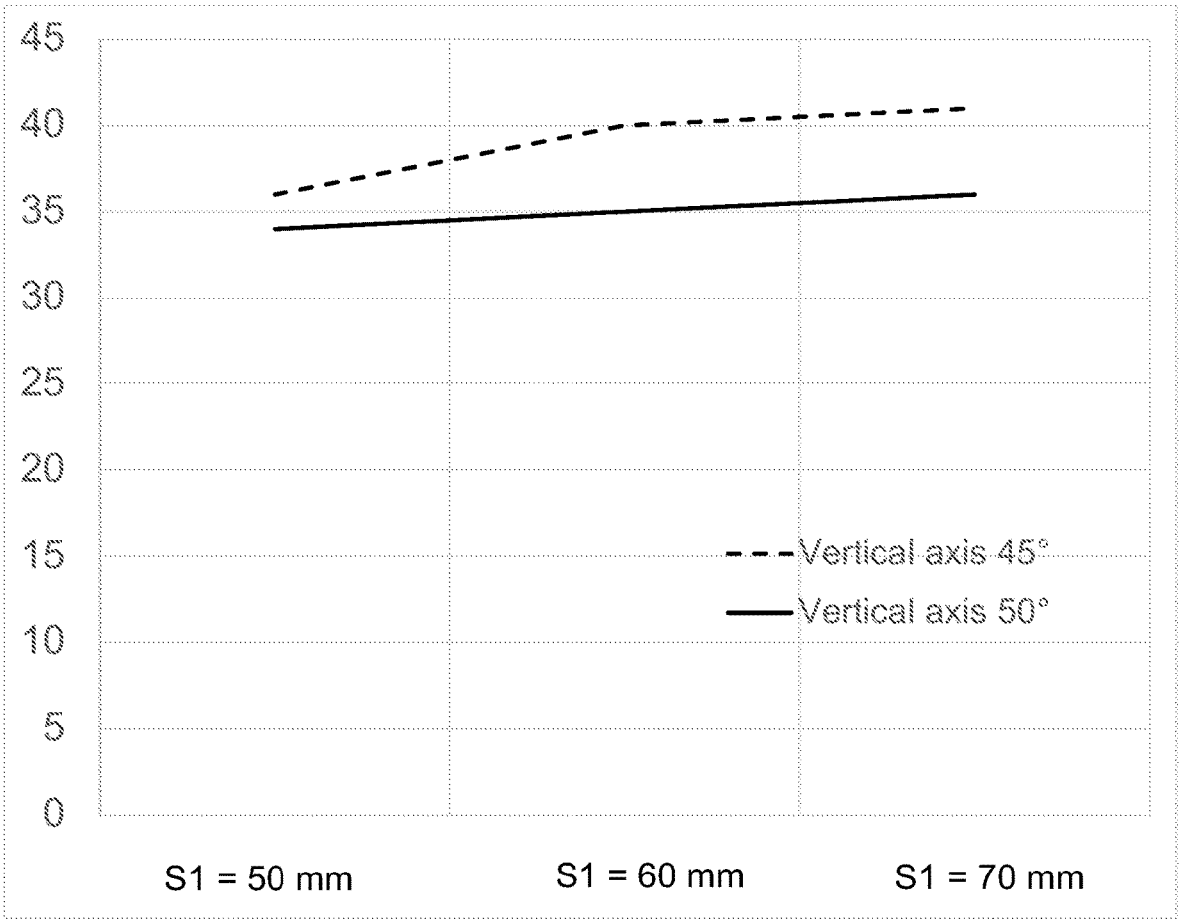

FIGS. 18 and 19 show diagrams of the optimal steering axle parameters

FIG. 1 shows a wheel axle 24 according to the invention in partial section, consisting of the fixed bearing block 1 and the movable axle part 98 (FIG. 2*d*), as well as the bearing washers 12*a* and 12*b* that are provided between these two parts in the openings 30 and 31 by way of example. Portion 2 (FIG. 2*d*) of the movable axle part 98 also has the bearing sleeve 14 (FIGS. 2*a*, 2*b*, 2*c*) in its opening 10 and an additional axial bearing unit in its opening 9, the construction being held together by the screw bolt 13 and the nut 17. Practical riding tests have shown that slide bearing combinations of metal rings and slide bearing rings 12*a*, 12*b* (FIG. 2*a*) and 12*a*, 12*b*, 12*c*, 12*d*, 12*e* (FIG. 2*b*), or 12*g*, 12*h*, 12*k* (FIG. 12*c*) have the best steering characteristics if the average bearing diameter 18 (FIG. 1) is provided in a preferred size of from 20 to 50 mm in consideration of the angular mounting position on a chassis or skateboard. The two front-side bearing planes are on or parallel to the plane AB, which, in turn is normal to the vertical median longitudinal plane and extends at a predetermined angle from the front bottom to the rear top. Furthermore, the vertical axis CD is located on the vertical median longitudinal plane, the angle between the vertical axis CD and the longitudinal axis EF being in the range between 5° and 85°, better between 30° and 60°, and best between 40° and 50°. The swiveling movements of the part 98 thus take place along or parallel to the plane AB and about the axis CD. The movable axle part 98 consists substantially of portions 2, 3, 4, 5, and 8, portion 2 being angled away from portion 4 in the region 5 in the direction of the deck standing surface 52, whereby the distance line 33, which extends from the center of the axle 8 and is normal to the axis CD, is shortened to the distance 20.

Figure 2A:
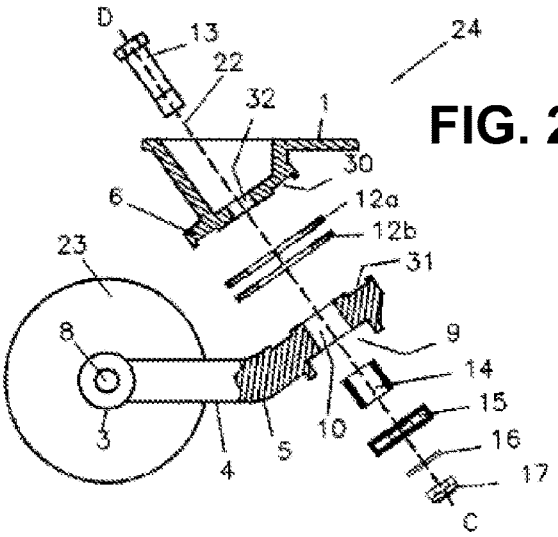
Figure 2B:
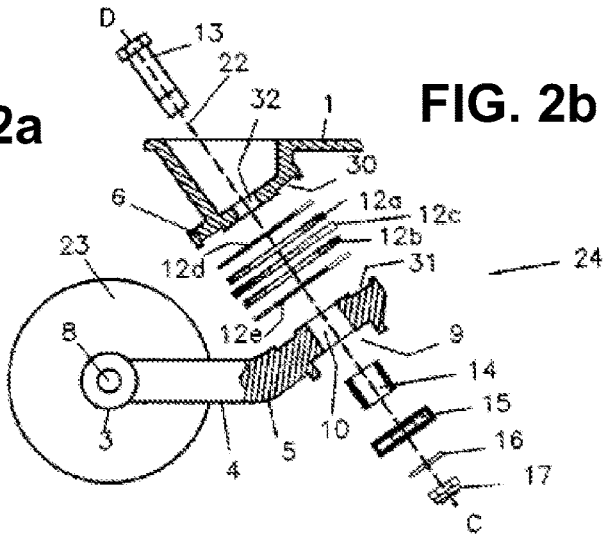
Figure 2C:
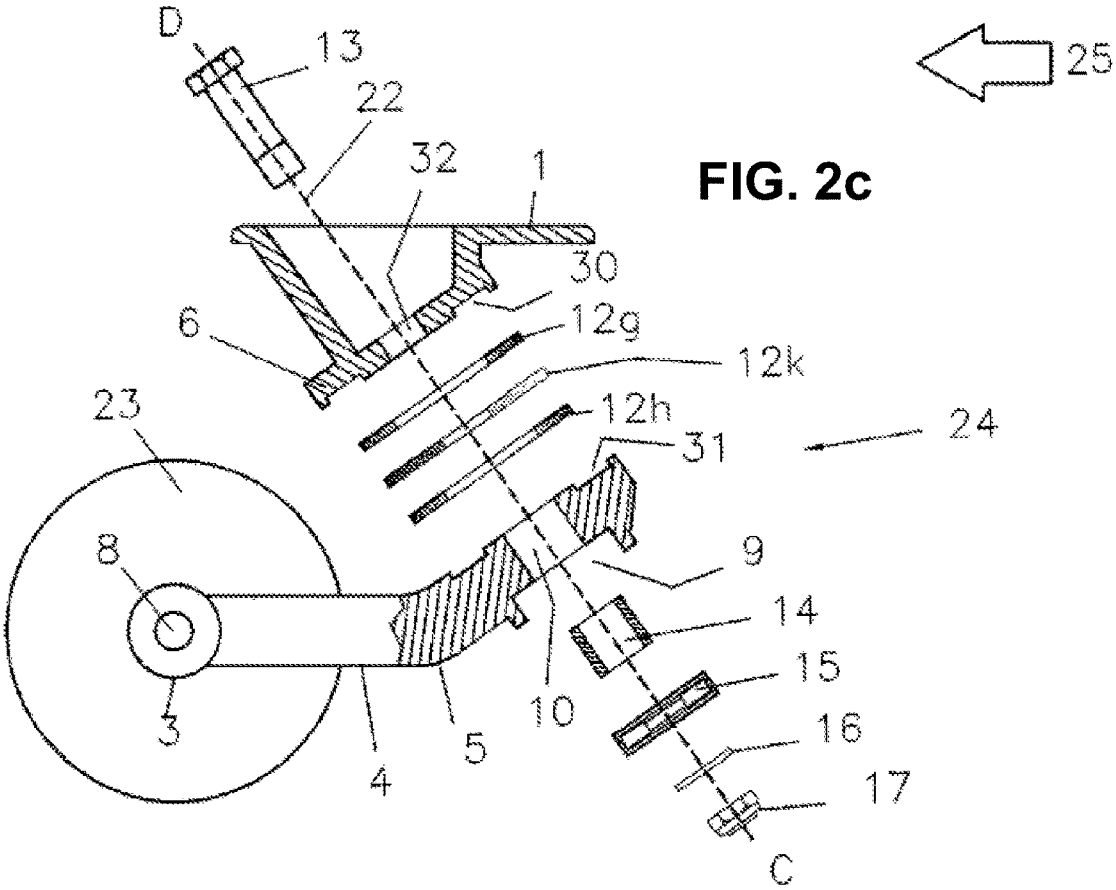

FIGS. 2*a*, 2*b* and 2*c* show exploded views of the axle unit 24 with different embodiments of axial bearings, consisting of the fixed part 1 and the movable axle part 98, with the axis CD extending normal thereto, through portion 2 thereof, and centrally through the opening 10 thereof. An axial rolling-element bearing that is preferably adequate for one of the slide bearing combinations according to FIG. 2*a*, 2*b*, or 2*c* is located between the bearing block 1 and the steering axle 98, and a radial bearing for the screw bolt 13—preferably a force-fit bearing sleeve—is disposed in the opening 10. The screw bolt 13 serves to screw the assembly 24 together; it is disposed in a non-rotating manner in the housing 1 and connects parts 1 and 98, the axial bearing 15 being disposed in the opening 9, so after the screw connection is established by means of the nut 17, a backlash-free swiveling of the movable axle part 98 is ensured independently of a potentially divergent height and without a torque acting on the nut 17 during swiveling of the part 98.

Figure 2D:
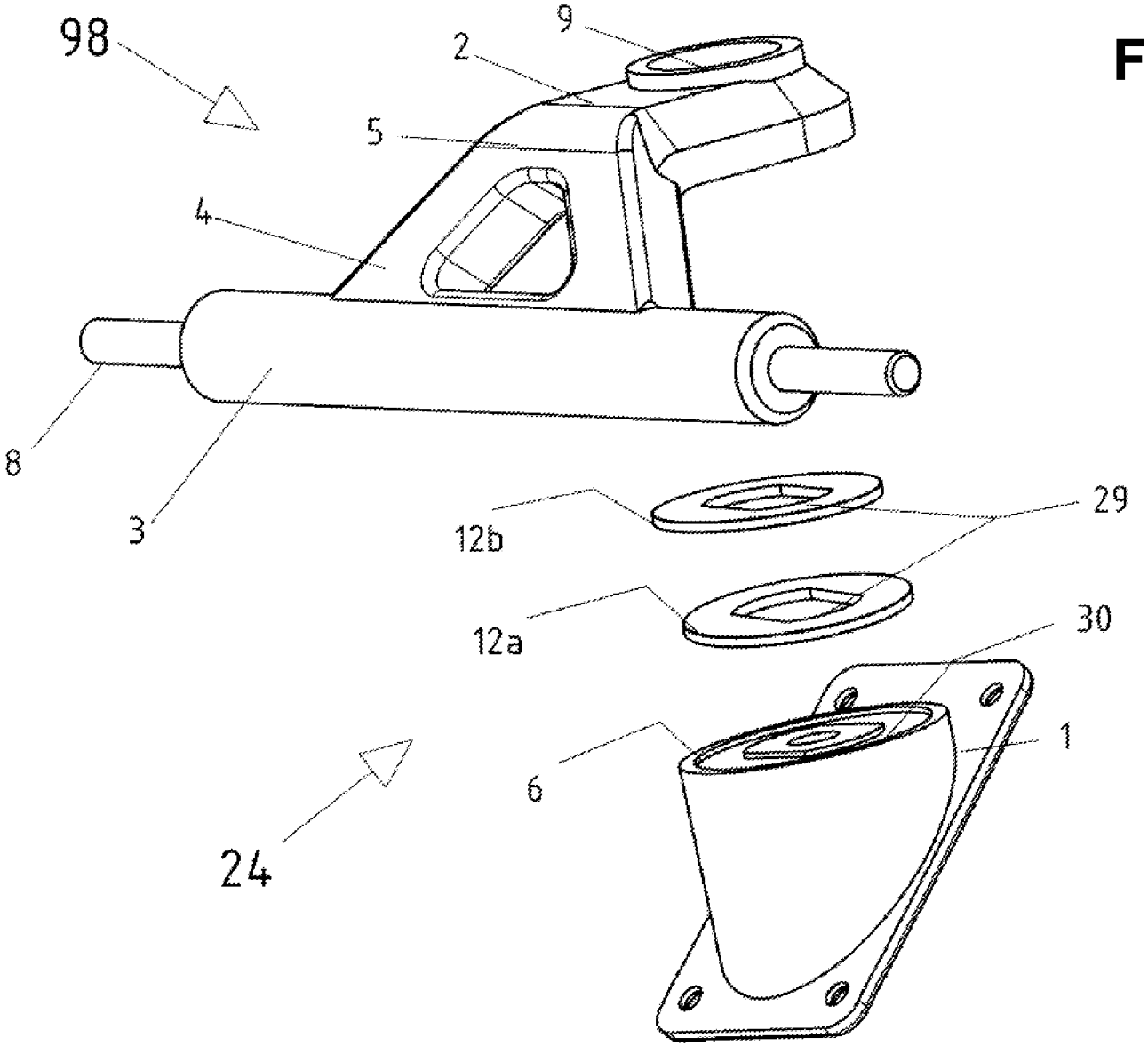

FIG. 2*d* shows parts of the front steering axles as an assembly 24 in an oblique view, with anti-torsion means being provided for the two slide bearing washers 12*a*/12*b* by means of a geometry 29 on their inner side that deviates from a circular path in a congruent form both on the bearing washers and on the connecting surfaces of parts 1 and 98. FIG. 2*b* shows a sliding bearing device in which the flat steel rings 12*d* and 12*e* are inserted into the recesses 30 and 31; the bearing washers 12*a* and 12*b* slide on these, with the annular steel washer 12*c* being provided between these two slide bearing washers. FIG. 2*c* shows another embodiment in which a flat steel ring is disposed in each of the circular recesses 30 and 31 but projects beyond these recesses, with a slide bearing washer 12*k* being disposed between the two flat steel rings that remains centrally positioned as a result of the screw bolt 13.

FIG. 3 shows a steering axle unit from the underside in an oblique view that consists, on the one hand, of the bearing block 1, which has the angled protruding surface 6 that defines the plane AB and thus forms a boundary surface portion relative to the movable axle part 98 and has the spacing axial bearing 12*a*, and, on the other hand, the axle part 98, which can be moved along the plane AB and has the opening 9 for receiving an axial bearing 15 and the opening 10 for receiving the screw bolt 13. The movable axle part 98, in turn, has straight portions 2 and 4 that are bent in the region 5 in the direction of the bearing block 1, with the axle body 3 that carries the axle 8 being provided on the two extensions 4, and with the two ends of the axle 8 that carry rollers or wheels projecting from the axle body 3.

FIG. 4 shows a steering axle unit from the top side in an oblique view, the top side 6 that projects at an angle therefrom having an arcuate clearance 26 with its lateral abutment surfaces 27 and 28, and that the extension 29 of the axle part 98 moves in a curved manner within these limits during swiveling. The top side of the bearing block 1 has a number of holes through which a secure connection with the deck of a chassis or skateboard is established by means of connecting elements such as screws, for example.

FIG. 10 shows a skateboard or chassis facing in the direction of travel 25 in the side view with a front steering axle unit 24 and a rear wheel suspension 99 that consists of the portions of bearing block 49 with an upper boundary surface 41, and that the bearing block 49 has a substantially horizontally rearward-facing opening for receiving the pivot 46 of the wheel axle 101, which, in turn, is screwed in place between the elastic members 43 and 44 by means of the kingpin screw 105 and the nut 104. This design enables the deck to tilt bilaterally without the rear axle deflecting. To improve longitudinal stability and steering, a provision is made that the elastic member 43 is greater in diameter, height, mass, and Shore hardness than the elastic member 44, which corresponds to the standard for skateboard axles. The longitudinal stability of such a skateboard is therefore dependent on the properties of the elastic parts of the rear wheel suspension 99 on the one hand and on the torque with which the screw 104 has been tightened on the other hand. In practical experiments, a certain torque on the bolt 104 was assigned to a wheel suspension 99 depending on the weight of the rider and the desired riding characteristics.

In another preferred embodiment, FIG. 11 shows a rear wheel suspension 99 in which the wheel axle 101 is located on the plane 82 that rises upward toward the front, with the result that the rear axle aids in steering against the curve during cornering, thus enlarging the radii traveled.

In another preferred embodiment, FIG. 12 shows a rear wheel suspension 99 in which the wheel axle 101 is disposed on the plane 84 that rises toward the rear, with the result that the rear axle deflects in the opposite direction during cornering, thus making it possible to travel along arches with smaller radii.

FIG. 5*a* shows a rear wheel suspension 99 as an assembly in an oblique view with the axle carrier 102 and the steering axle 101 screwed in place therein from which the axles 45 protrude on the front sides that carry wheels or rollers that are held in their position by screwing, with the rollers facing rearward in the installed position, also in order to prevent them from coming into contact with the rider's show while riding.

FIG. 5*b* shows an exemplary rear wheel axle 101 consisting of the transverse portion 42 and the extension 50, on the front end of which the pivot 46 is provided, the extension 50 having the hole 47 and recesses 48 on both sides.

FIGS. 6*a* and 6*b* compare an exemplary skateboard with a view of the underside thereof, with the front axle carrier 98 being deflected in FIG. 6*a*, from which it can be seen that the complete axle 8, which is arranged at a distance 56 in front of the pivot point 13, swivels out from the median longitudinal plane 51. In FIG. 6*a*, the front steering axle has at least one steering shock absorber 200 that is movably connected in the region 201 and supported with a fastening element 202 against the deck 52, so that steering deflection does not occur when riding faster over obstacles.

FIG. 7, in addition to FIGS. 6*a* and 6*b*, shows an exemplary skateboard viewed obliquely from below with a deck 52, a front wheel suspension 24 in the direction of travel 25, and a rear wheel suspension 99.

Both of FIGS. 8 and 9 compare the deflected end positions of the wheels as a function of the positions of the wheel transverse axles 8 relative to the axes of rotation 13. In FIG. 8*a*, the transverse axes 8 are arranged spatially at a distance 71 within the axes of rotation 13, with the result that the standing surface 65 on the inside of the curve between the vertical median longitudinal plane and the support points 63 and 64 is reduced to the smaller, less stable surface 66 upon full deflection. In FIG. 9*a*, the transverse axle 8 of the wheel axle unit 24 is located spatially at a distance 72 in front of the axis of rotation 13, whereby the standing surface located between the vertical median longitudinal plane and the support points 67 and 68 increases overall with a stabilizing effect. FIG. 9*c* shows an embodiment with two axle units 24 according to the invention, whereby the surface 70 is increased again.

FIGS. 14 and 15 show additional preferred embodiments of chassis in various embodiments and views, with a board 52 having a front axle unit 24 and a rear axle unit 99; in FIG. 14*a*, a rigid, removable, telescopic, or foldable handlebar 90 having an exemplary handle part 14 protrudes from the board 52.

FIGS. 14*b* and 14*c* show an embodiment with 3 wheels, with the single rigidly mounted rear wheel 93 having a convex cross section. FIG. 14*d* shows the same embodiment in an oblique view from below. Some embodiments of FIG. 14*d* comprise a skateboard or chassis with a rigid, detachable, telescopic, or foldable handlebar 90, wherein the deck 52 is bent in the front region at the two locations 120 and 122 by the exemplary angled length 121, so that the board 52 is lowered pronouncedly in the direction of the standing surface 100 by this measure in order to increase the riding comfort, and the rear wheel or the rear roller can thus be stored directly in the vicinity of the board height in a clearance in the deck in the axle region 123.

In oblique view from below, FIG. 15 shows another embodiment of an exemplary chassis with front and rear moving axles and with a total of 4 rollers or wheels. A board 52 has an axle unit 24 on its front side and an axle unit 99 on the rear side. The embodiment of the rear axle unit 99 has been selected here by way of example. Depending on the desired riding characteristics, combinations according to FIGS. 10, 11, 12 and 13 are possible.

Figure 16:
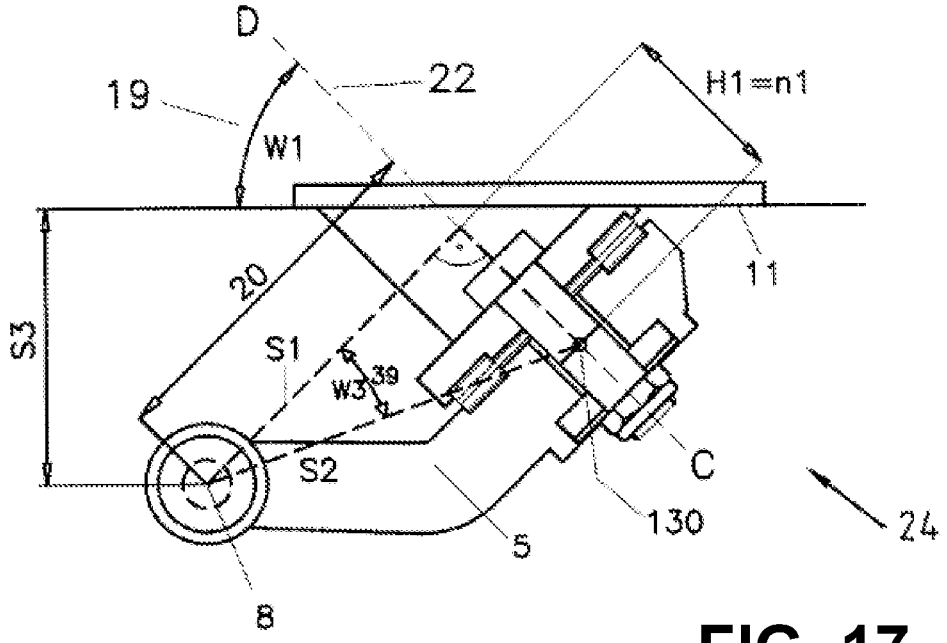

FIG. 16 shows a cross section of a front steering axle unit 24 that is aligned straight relative to the vertical median longitudinal plane in which the vertical axis CD 22 is provided in a preferred angular range of from 40 to 50 degrees, the straight line S2 running longitudinally through the two points 8 and 130 and, in turn, forming the angle W3 with the CD normal S1 of length 20. The apex of the angle W3 between the two legs S1 and S2 has its geometric origin in the center of the transverse axle 8, with S2 extending between the apex 8 and the point 130, which, in turn, lies approximately at the mean bearing height of the steering axle body 98, which can be moved about the axis CD. FIG. 16 also shows the reference point 130 lying on the axis CD at the distance H1 and in FIG. 17 at the distance H2, starting from the point of intersection of the axis CD with the normal 81. The parameters of the inventively optimized geometry of these steering kinematics were defined by experiments and/or derived therefrom as follows:

Angle W1 of the axis CD22 between 40° and 60° with the normal S1 of length 20 projecting therefrom in the range from 40 to 80 mm and the vertical distance between the transverse axle 8 and the reference surface 11 with a dimension of S3=30 to 60 mm. This results in the distance: S2=(S1/cos angle W3).

Unless explicitly stated otherwise, the range lying between H1 and H2 is found from: H1(H2)=S1×tan angle W3. The optimal angular range W3 is found as follows: W3=(H/S 1)$\tan^{-1}$ FIG. 18 shows a diagram that was created with the values of the various exemplary angles W2 from the six FIGS. 16*a* to 17*c*, with the range of ratio values included in the graph of the two curves yielding optimum steering ratios.

In other preferred embodiments, all of the boards with steering axles in the various versions and combinations are provided with a drive, particularly an electric drive in the form of a hub motor and/or axle drive.

The invention claimed is:

1. A steering axle unit (24) for chassis or skateboards, comprising a bearing block (1) and a steering axle body (98), wherein the bearing block (1) comprises a fastening plane (11) for fastening to a chassis or skateboard, wherein, in an assembled state, the fastening plane (11) is arranged on the chassis or skateboard so as to be parallel to a designated direction of travel (25) of the chassis or skateboard, and wherein the bearing block (1) further comprises a vertical axis CD (22) about which the steering axle body (98) is rotatable relative to the bearing block (1), and an axle (8) that projects normally from the vertical median longitudinal plane of the bearing block (1) when in the assembled state as a steering axle unit (24) in a straight-ahead position, wherein the vertical axis CD (22) is arranged on the median longitudinal plane of the bearing block (1) at an angle W1 (19) of less than 90° relative to the fastening plane (11) in the direction of the steering axle body (98), and wherein the axle (8) is arranged at a normal distance (20, S1) to the vertical axis CD (22), and that the axle (8) is arranged both in front of the vertical axis CD (22) in the designated direction of travel (25) of the chassis or skateboard and above a plane AB (21) formed by an interface of the steering axle body (98) and the bearing block (1).

2. The steering axle unit (24) of claim 1, wherein the steering axle unit (24) has bearing units (12*a*, 12*b*) or (12*a*, 12*b*, 12*c*, 12*d*, 12*e*) or (12*g*, 12*h*, 12*k*) that are arranged between the steering axle body (98) and the bearing block (1), with the plane AB (21) lying on the plane of contact of the bearing units (12*a*, 12*b* or 12*a*, 12*b*, 12*c*, 12*d*, 12*e* or 12*g*, 12*h*, 12*k*) and being arranged perpendicular to the vertical axis CD (22).

3. The steering axle unit (24) of claim 1, wherein the angle W1 (19) between the vertical axis CD (22) and the fastening plane (11) of the bearing block (1) is between 30° and 70°, between 40° and 60°, or between 45° and 50°.

4. The steering axle unit (24) of claim 1, wherein a bearing unit (12*a*, 12*b* or 12*a*, 12*b*, 12*c*, 12*d*, 12*e* or 12*g*, 12*h*, 12*k*) with a maximally large mean diameter C (18), particularly between 25 mm and 50 mm, is provided between the bearing block (1) and the steering axle body (98), wherein the bearing block (1) and the steering axle body (98) are connected by means of a fastening element (13), wherein the steering axle body (98) has an additional bearing unit (15) on an outer side that is situated opposite the bearing unit (12*a*, 12*b* or 12*a*, 12*b*, 12*c*, 12*d*, 12*e* or 12*g*, 12*h*, 12*k*), and wherein a radially acting bearing sleeve (14) is arranged between the steering axle body (98) and the additional bearing unit (15).

5. The steering axle unit (24) of claim 1, wherein the steering axle body (98) is angled upward in a bending region (5) in the direction of the fastening plane (11) of the bearing block (1) when the steering axle unit (24) is in a straight-ahead position and carries the axle (8) at the end opposite the vertical axis CD (22) at the normal distance (20, S1), the normal distance (20, S1) of the axle (8) to the vertical axis CD (22) being between 30 mm and 90 mm, or between 50 mm and 70 mm.

6. The steering axle unit (24) of claim 1, wherein an angle W3 (39), between the fastening plane (11) of the bearing block (1) and a line (38) connecting the axle (8) to a point of rotation of the steering axle body (98), is between 22° and 40°.

7. The steering axle unit (24) of claim 1, wherein the bearing block (1) has an arcuate clearance (26) on its outer peripheral line with two lateral abutment surfaces (27, 28), wherein the steering axle body (98) has on an inner side an extension (29) that corresponds to the two lateral abutment surfaces (27, 28), and wherein the two lateral abutment surfaces (27, 28) and the extension (29) form a stop for the movement of the steering axle body (98) relative to the bearing block (1).

8. A skateboard or chassis, comprising at least one steering axle unit (24) as set forth in claim 1.

9. The skateboard or chassis of claim 8, wherein the steering axle unit (24) is arranged in front of the skateboard or chassis in the designated direction of travel (25).

10. The skateboard or chassis of claim 8, wherein the axle (8) is arranged in front of the vertical axis CD (22) in the designated direction of travel (25) and/or that the vertical axis CD (22) extends from the top in the front to the bottom in the rear relative to a chassis or skateboard that is standing on the ground.

11. The skateboard or chassis according to claim 8, further comprising a rear wheel axle unit (99) the rear wheel axle unit (99) comprising a rear bearing block (49) and a rear axle part (101), wherein the rear bearing block (49) comprises an opening that is open horizontally toward a rear of the skateboard or chassis in the direction of travel (25) of the skateboard or chassis, wherein the opening is designed to receive a pivot (46) of the rear axle part (101), and wherein the rear axle part (101), which further comprises an axle (45) and an opening (47) for a kingpin screw (105), is flat when carrying rollers or wheels such that the pivot (46) and the opening (47), within which resides the kingpin screw (105), is normal to a standing surface of the skateboard or chassis when in the installed position, and the axle (45) is located substantially on a horizontal plane EF (35) or parallel thereto when in an installed position, and wherein the rear axle part (101) is connected to the rear bearing block (49) by means of elastic members (43, 44) of variable size and hardness by means of a fastening element comprising a kingpin screw (105) and a nut (104).

12. The skateboard or chassis according to claim 11, wherein the rear wheel axle unit (99) comprises a combination of two elastic members comprising an upper elastic part (43) and a lower elastic part (44) of different size and hardness, wherein the upper elastic part (43) is arranged between the rear axle part (101) and the rear bearing block (49), wherein the upper elastic part (43) has a diameter of between 25 and 30 mm and a Shore hardness from 95 to 100 ShA, and wherein the lower elastic part (44) is arranged between nut (104) and rear axle part (101), the lower elastic part (44) being smaller and having a lower Shore hardness than the upper elastic part (43).

13. The skateboard or chassis of claim 11, wherein the pivot (46) of the rear wheel axle unit (99) is arranged on a vertical median longitudinal plane horizontally in front of a kingpin screw (105), or the pivot (46) points upward toward a front end of the skateboard or chassis in the direction of travel (25) while lying on a plane (82) in front of the kingpin screw (105), or the pivot (46) is located on a plane (84) behind the kingpin screw (105) and points upward toward the a rear end of the skateboard or chassis in the direction of travel (25).

14. The skateboard or chassis of claim 8, wherein the skateboard or chassis has a rigid, removable, telescopic, and/or foldable handlebar (90) that protrudes upward in a direction of travel (25) and has a handle part (14).

15. The skateboard or chassis of claim 8, wherein the front steering axle unit (24) has at least one steering shock absorber (200) that is movably connected in the region 201 and is supported with any fastening element (202) against a deck (52) of the skateboard or chassis.

16. The skateboard or chassis of either one of claims 8 or 11, wherein the skateboard or chassis comprises a drive, the wheels or rollers of the rear axle part (101) are drivable by the drive.

17. The skateboard or chassis of claim 16, wherein the drive comprises an electric drive.

* * * * *